US011077468B2

(12) United States Patent
Sanz Uribe et al.

(10) Patent No.: US 11,077,468 B2
(45) Date of Patent: Aug. 3, 2021

(54) DEVICE AND METHOD FOR CLASSIFYING SEEDS

(71) Applicant: Federación Nacional de Cafeteros de Colombia, Bogota (CO)

(72) Inventors: Juan Rodrigo Sanz Uribe, Bogota (CO); Paula Jimena Ramos Giraldo, Bogota (CO); Juan Mateo Castrillon Cuervo, Bogota (CO); John Alejandro Ríos González, Bogota (CO); Daniel Aristizabal Arias, Bogota (CO)

(73) Assignee: Federación Nacional de Cafeteros de Colombia, Bogotá (CO)

( * ) Notice: Subject to any disclaimer, the term of this patent is extended or adjusted under 35 U.S.C. 154(b) by 105 days.

(21) Appl. No.: 16/307,804

(22) PCT Filed: Jun. 7, 2017

(86) PCT No.: PCT/IB2017/053377

§ 371 (c)(1),
(2) Date: Dec. 6, 2018

(87) PCT Pub. No.: WO2017/212427

PCT Pub. Date: Dec. 14, 2017

(65) Prior Publication Data

US 2020/0156119 A1 May 21, 2020

Related U.S. Application Data

(60) Provisional application No. 62/347,065, filed on Jun. 7, 2016.

(51) Int. Cl.
*B07C 5/342* (2006.01)

(52) U.S. Cl.
CPC ..... *B07C 5/3422* (2013.01)

(58) Field of Classification Search
USPC ..... 209/577
See application file for complete search history.

(56) References Cited

U.S. PATENT DOCUMENTS 4,203,522 A 5/1980 Fraenkel et al.
4,513,868 A 4/1985 Culling et al.
(Continued)

FOREIGN PATENT DOCUMENTS

CA 1308384 C * 10/1992
CN 104084379 10/2014

*Primary Examiner* — Terrell H Matthews
(74) *Attorney, Agent, or Firm* — The Morales Law Firm; Joseph L. Morales

(57) ABSTRACT

The present invention relates to a device and method for classifying seeds, for example coffee seeds. The device is characterised by: a seed-feeding mechanism; a seed-containing mechanism connected to the seed-feeding mechanism; an electronic seed-viewing system operationally disposed in the seed-containing mechanism; a seed-ejecting mechanism connected to the outlet of the seed-containing mechanism, the electronic seed-viewing system having a central processing unit that implements methods for classifying seeds. The method is characterised by the steps of: a) obtaining a digital image of the seed; b) storing the RGB components of the image obtained in step a); c) generating a histogram for each colorimetric and luminosity component of the histogram of step b); d) determining the thresholding point according to Otsu's method; e) obtaining a binary image; f) removing areas; g) obtaining the edges; h) obtaining the vectors corresponding to the seeds; i) identifying black seeds; j) identifying seeds with fermentation- and immaturity-related defects; k) identifying seeds with mechanical damage; and l) actuating a seed-ejecting mechanism, activating actuators for black seeds, actuators for seeds with fermentation- and immaturity-related defects and actuators for seeds with mechanical damage.

6 Claims, 9 Drawing Sheets

(56) References Cited

U.S. PATENT DOCUMENTS

| | | | | |
|---|---|---|---|---|
| 4,630,736 | A | 12/1986 | Maughan et al. | |
| 4,699,273 | A | 10/1987 | Suggi-Liverani et al. | |
| 5,135,114 | A | 8/1992 | Satake et al. | |
| 5,538,142 | A | 7/1996 | Davis et al. | |
| 5,659,624 | A * | 8/1997 | Fazzari | B07C 5/3422 209/580 |
| 5,873,470 | A * | 2/1999 | Davis | B07C 5/3422 209/555 |
| 5,973,286 | A * | 10/1999 | Wan | B07C 5/3422 209/254 |
| 6,191,859 | B1 | 2/2001 | Winterbottom et al. | |
| 2008/0310674 | A1 * | 12/2008 | Modiano | G01N 21/6428 382/100 |
| 2008/0317279 | A1 * | 12/2008 | Deppermann | G01N 15/1463 382/100 |
| 2013/0168301 | A1 | 7/2013 | Dell'Endice et al. | |

* cited by examiner

DEVICE AND METHOD FOR CLASSIFYING SEEDS

FIELD OF THE INVENTION

The present invention relates to devices for classifying beans, especially washed coffee beans.

DESCRIPTION OF THE PRIOR ART

Classification of agricultural products leads to higher-quality offerings, which are bought at higher prices. The market for specialty coffees, those that are valued higher due to their unique characteristics, is a good example of the above. Although there are machines in the coffee process that select products of excellent quality, there is a type of bean that cannot be removed by means of traditional processes; those beans that have been mildly affected by the Coffee berry borer.

The Coffee berry borer (*Hypothenemus hampei*) is the most aggressive plague in coffee plantations in Colombia, causing mayor economic damage to coffee growers due to a decline in quality. Given that coffee beans that have been mildly affected by this plague are difficult to remove from the main crop during coffee processing and before exporting, this patent proposes an alternative for removing CBB-affected beans and beans with defective endosperm, during wet processing, in order to give coffee growers the opportunity to earn a higher income by producing higher-quality coffee and provide higher-quality raw material to exporters.

There are patents for systems that use computer vision techniques to identify and separate objects that possess different characteristics from others. Similarly, there are many examples in agricultural industry of machines that use these techniques to classify agricultural products. All of these technologies have a raw material conditioner, a feeder, an object analysis system, and a removal system that responds to commands sent by the analysis system.

In prior art, there are systems in which digital image analysis is used to make decisions to determine whether or not an agricultural product is acceptable, which include ejection systems to remove grains of varying quality from the main flow, such as patents U.S. Pat. Nos. 4,203,522, 4,513,868, 4,630,736, 4,699,273, 5,538,142, 6,191,859 and 5,135,114. However, the method used in analyzing products in order to determine whether or not they are acceptable varies from product to product.

Some brands of machines for selecting agricultural products available on the market are Weco, Cimbria, Sortex, Spectrum, Hongshi, Angelon, Isort, ABD, Really, Aslanjixie, ZRWS, SKS, Jietai Zhineng, WB, WY, S-Precision, Xeltron, Delta, among others. These machines handle dry and semi-dry raw materials, unlike the machine in this patent, which classifies a completely wet product. Coffee in this state has an average humidity of 53%, wet basis, and has a water film on its surface.

DESCRIPTION OF THE INVENTION

The present invention corresponds to a device and methods for bean classification. The device contains a mechanism that feeds beans, a mechanism that arranges beans, which in one embodiment of the invention, arranges the beans with the flat side up, an electronic bean vision system and a pneumatic ejection mechanism.

In one embodiment of the invention, the beans to be classified are washed coffee beans.

Figure 1:
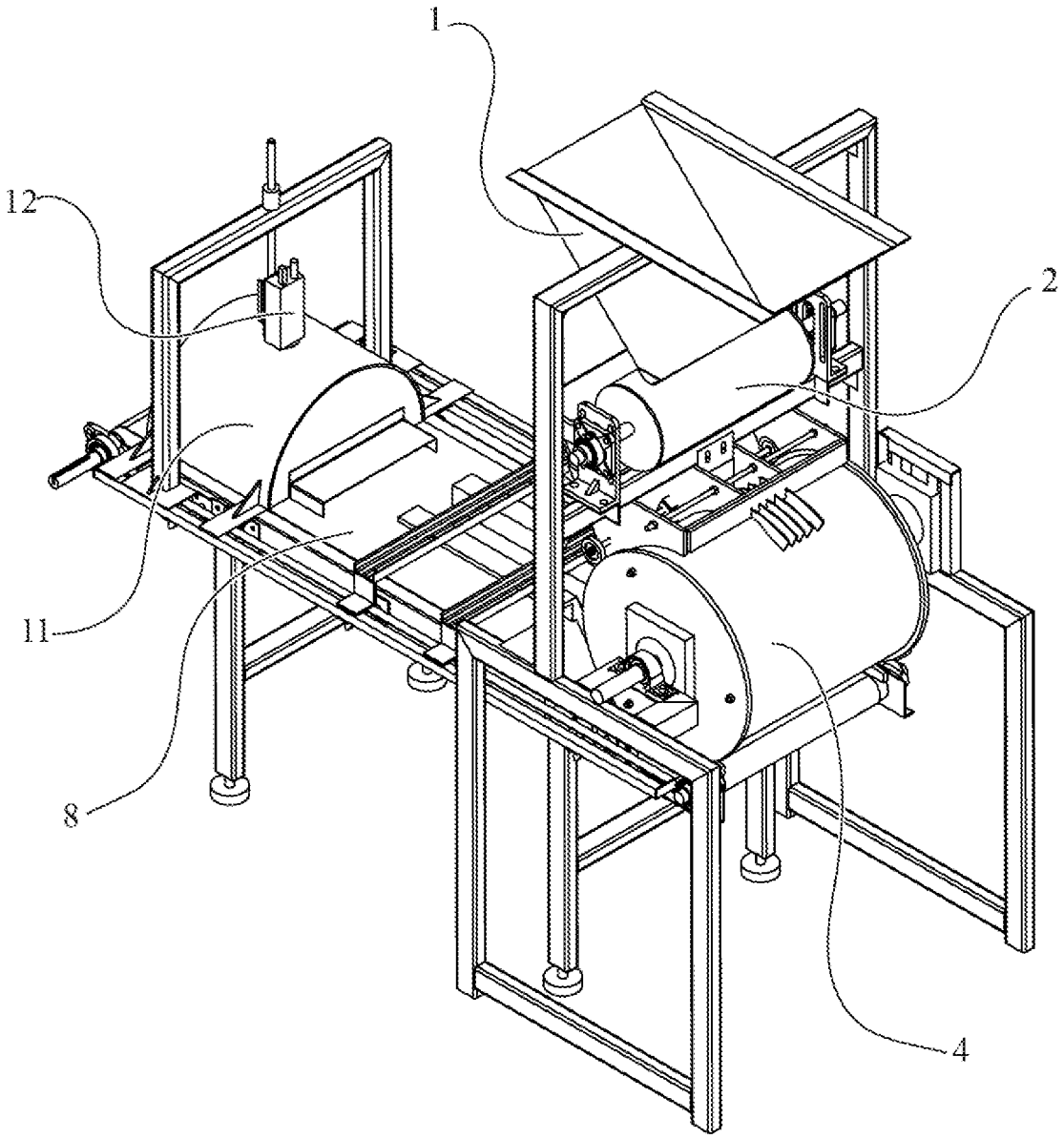
FIG. 1 is an elevated frontal perspective view of a preferred embodiment of the device for classifying beans herein disclosed.

The method of the present invention is a method for classifying beans, characterized by the following stages a. capturing the digital image of the bean;
b. storing the RGB components of the image captured in stage a;
c. creating a histogram for each colorimetric and brightness component of the histogram from stage b;
d. determining the threshold point;
e. obtaining binary image;
f. removing areas;
g. obtaining the borders;
h. Obtaining the vectors that correspond to the beans;
i. Identifying black beans;
j. Identifying defective fermented and unripe beans;
k. Identifying beans with mechanical damage;
l. Engaging a bean ejection mechanism by activating actuators for black beans, actuators for defective fermented or unripe beans, and actuators for beans with mechanical damage.

one embodiment of the invention corresponds to a device for classifying coffee beans characterized by:

i) Referring to FIGS. 1. and 5, a feeding mechanism consisting of a main hopper (1) with longitudinal rods that prevent the formation of structures that block the continuous flow of coffee beans. A rotating drum with a smooth surface (2) that adds energy to continuously feed the washed coffee beans and a stretched nylon scraper (3) to detach the beans that may cling to the surface of the rotary drum.

Figure 2:
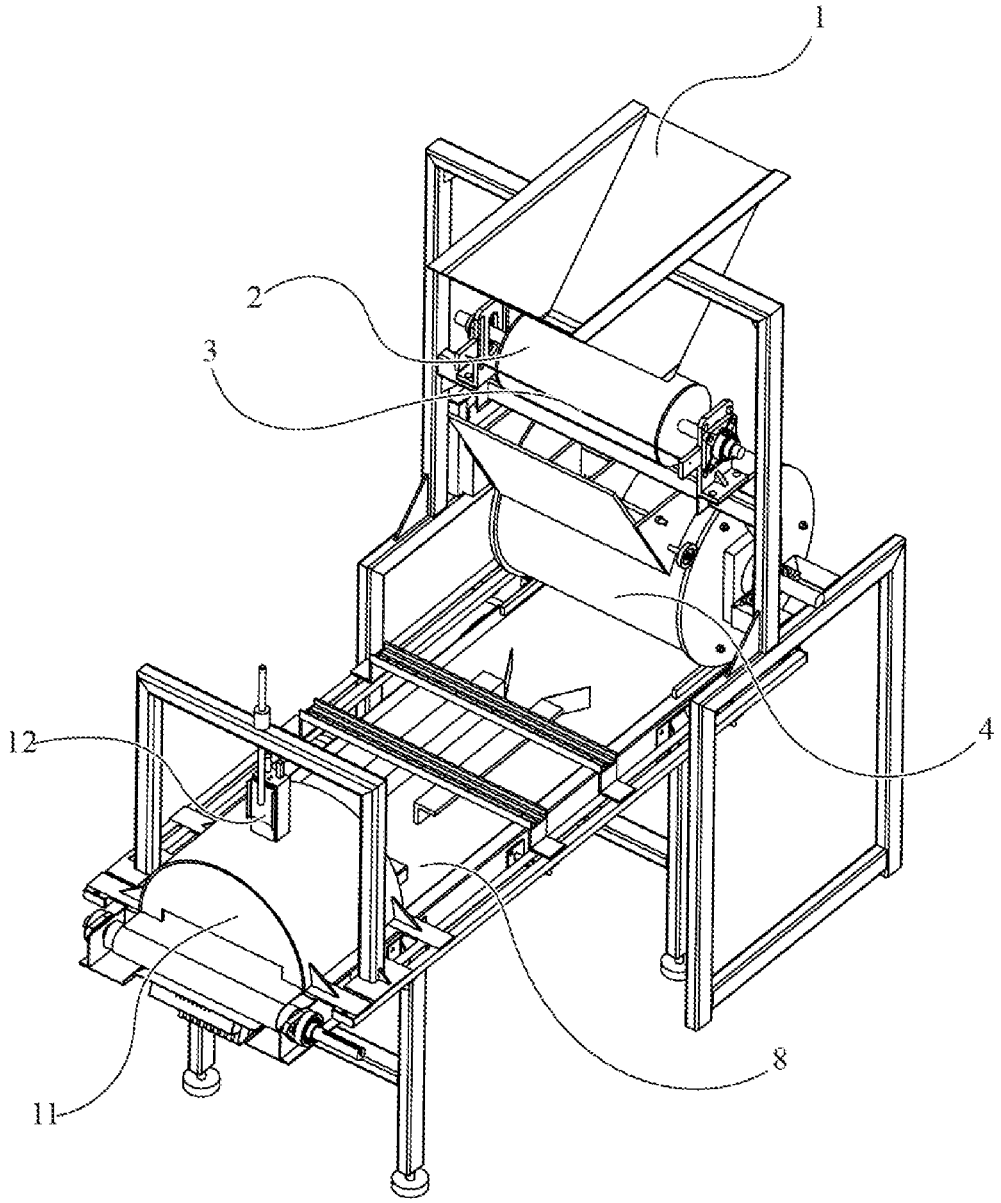
FIG. 2 corresponds to an elevated rear perspective view of a preferred embodiment of the device for classifying beans herein disclosed.
Figure 3:
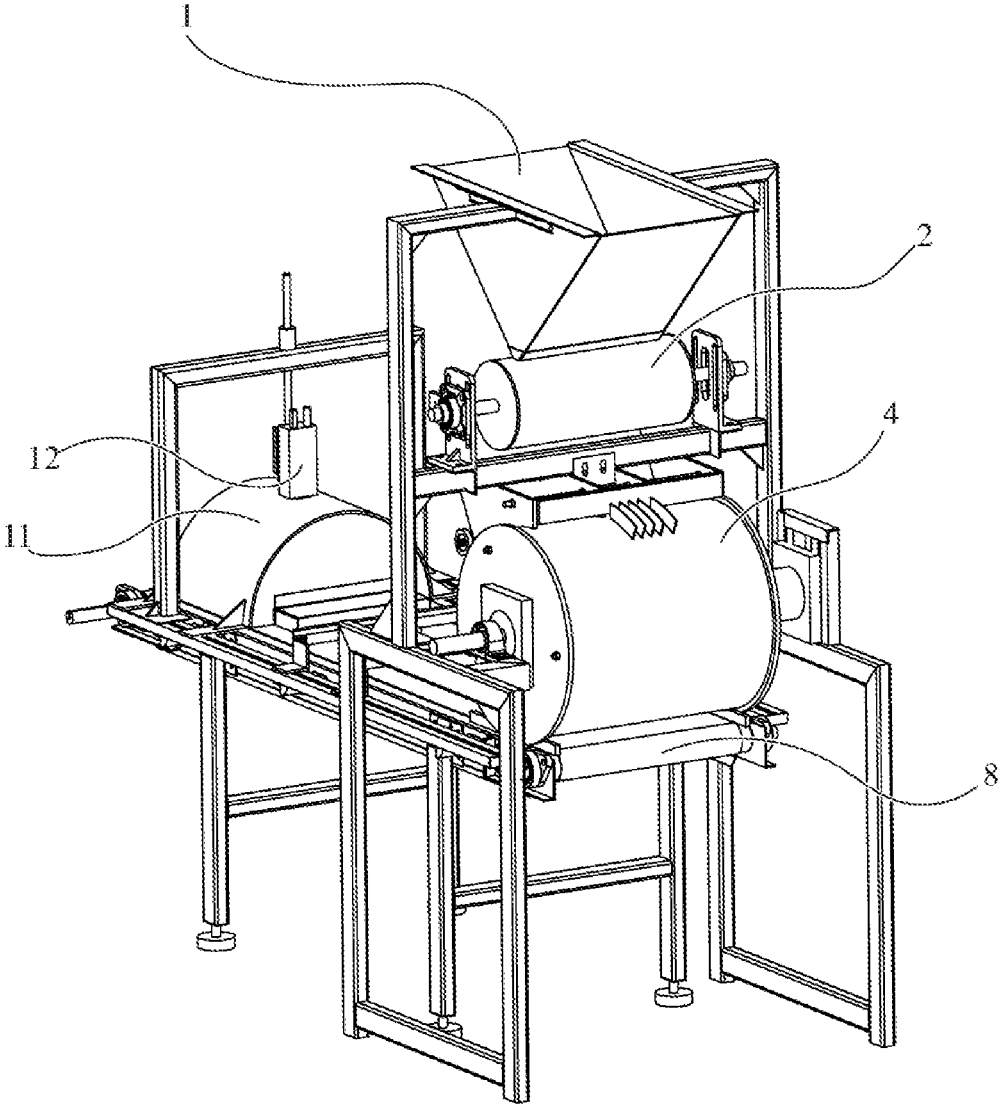
FIG. 3 displays a diagonal frontal view of a preferred embodiment of the device for classifying beans according to the present disclosure.
Figure 4:
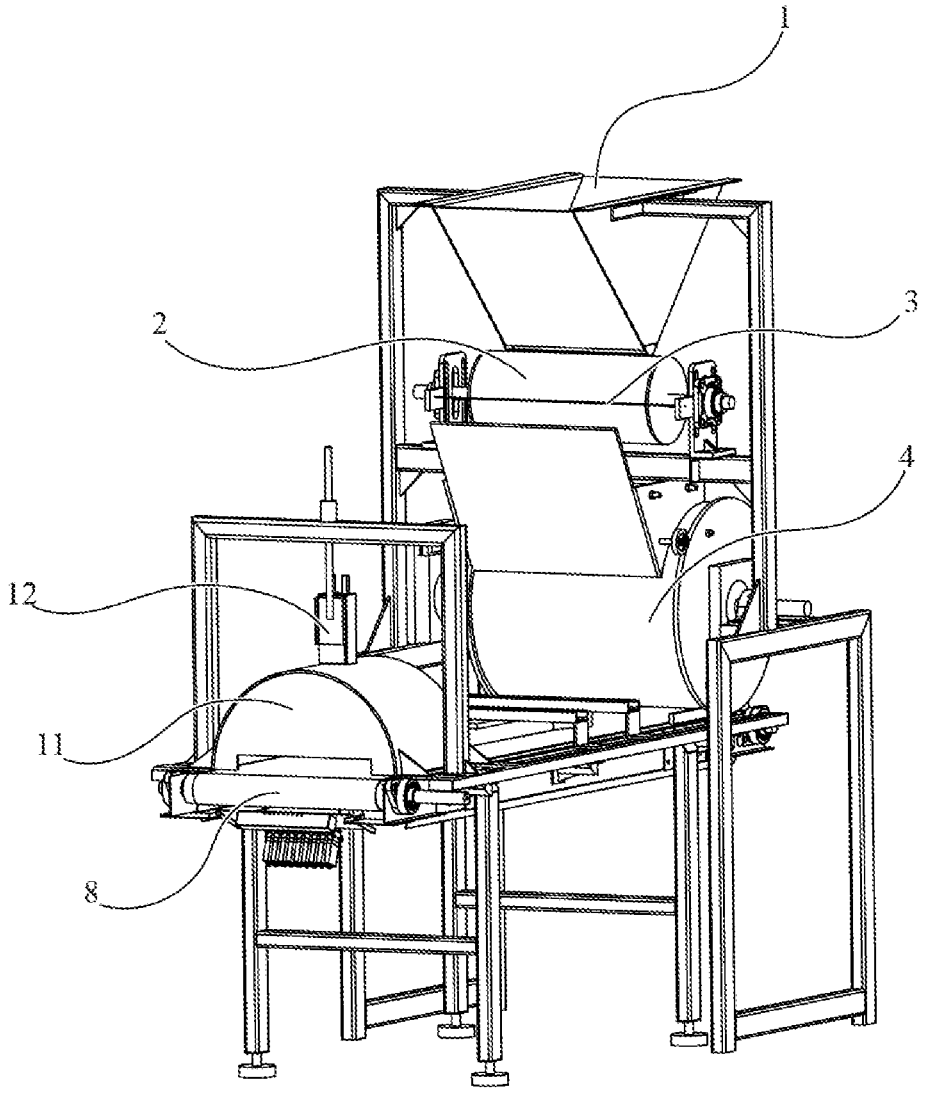
FIG. 4 corresponds to a diagonal rear view of a preferred embodiment of the device for classifying beans herein disclosed.
Figure 5:
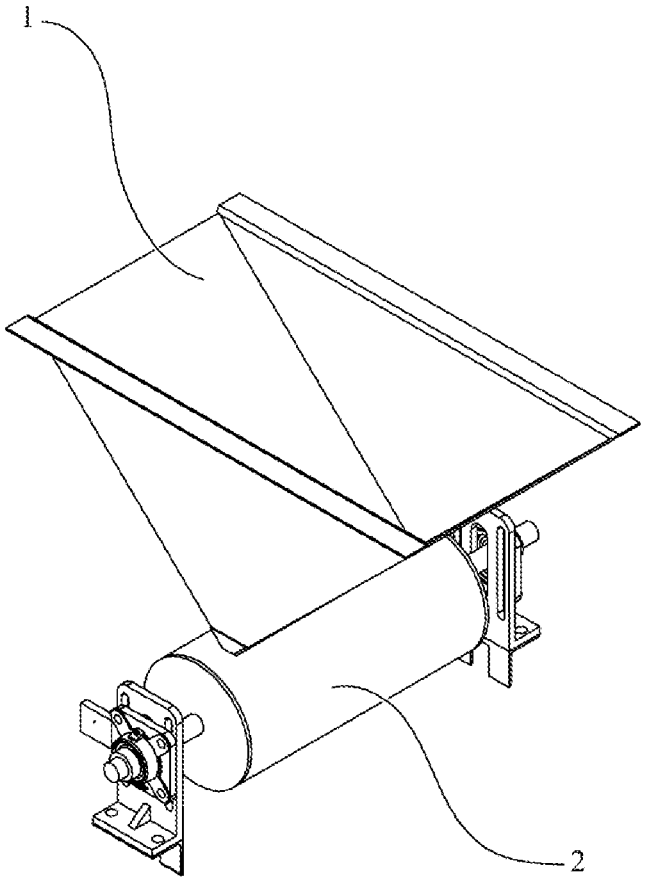
FIG. 5 illustrates a perspective view of the feeding mechanism according to a preferred embodiment of the device for classifying beans of the present disclosure.

In one embodiment of the invention, the feeding mechanism provides a continuous flow of washed coffee beans to the system.

ii) Referring to FIG. 1. FIG. 2, FIG. 3 and FIG. 4, a bean arrangement mechanism that arranges the washed coffee beans with the flat side up, consisting of another rotary drum (4) with a greater diameter with a smooth surface into which washed coffee beans are fed above a container (5) that possesses a stirrer (6). The beans are arranged with the flat side up (10) or down (9), which are held on the surfaces (9) by the adhesive and cohesive forces of water. The drum also has a stretched nylon scraper (7) which detaches the beans that may have clung by offloading them softly onto a horizontal conveyor belt (8) that moves at a slightly faster speed, with the flat side up.

Figure 9:
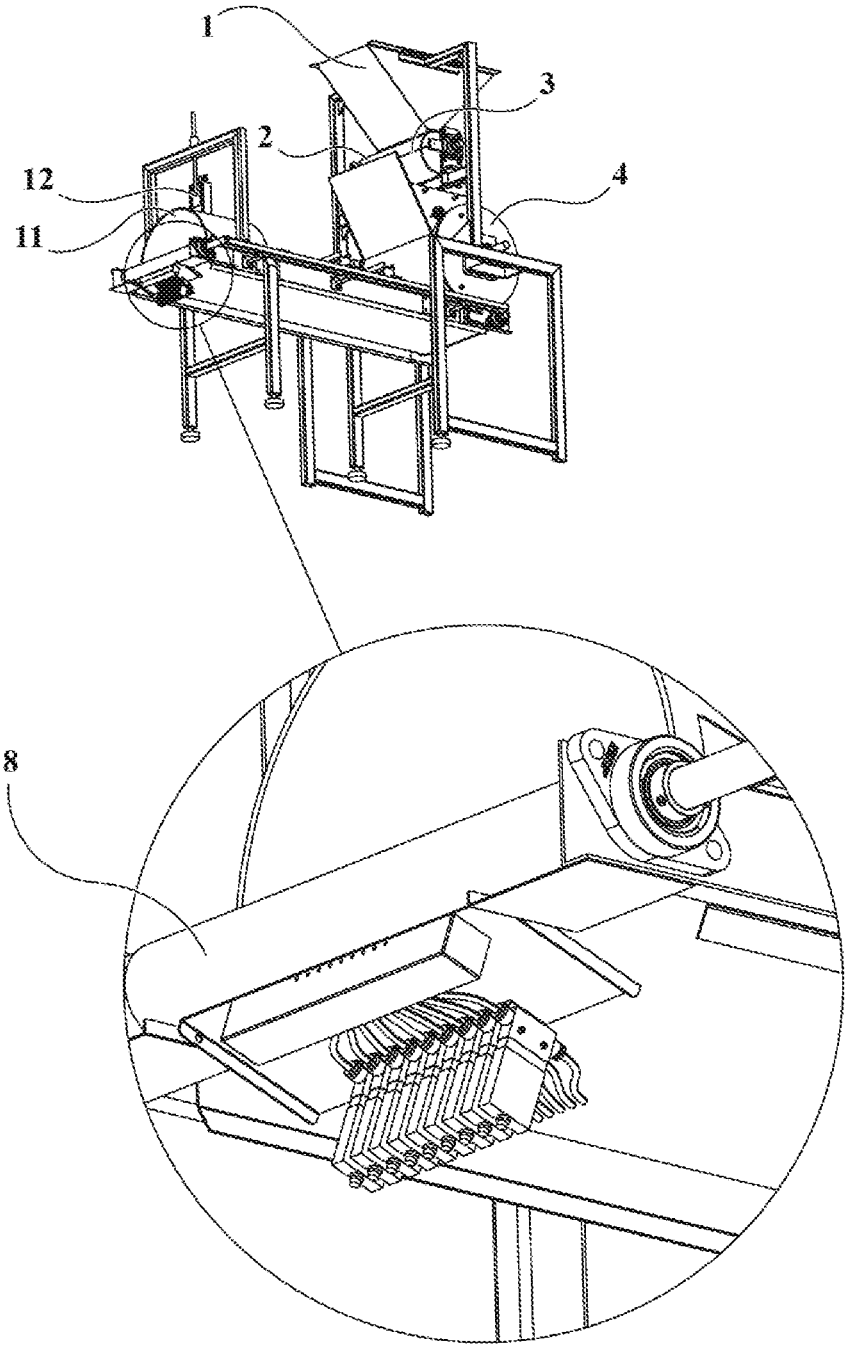
FIG. 9 shows a bottom perspective to detail the ejection mechanism of a preferred embodiment of the device herein disclosed.

The arrangement mechanism that arranges the coffee beans with the flat side up performs this task efficiently.

iii) Referring to FIGS. 4 and 9, an electronic bean vision system consisting of a CCD camera (12), an inspection hood (11), a lighting unit and a central processing unit, which can be a computer or an embedded (automatic) mechanism in which the analyses are performed and the decisions regarding the quality of the washed coffee beans are made.

In one embodiment of the invention, the lighting mechanism of the electronic bean vision system consists of high intensity LEDs.

The central processing unit processes a method for identifying the beans that are selected from the group that consists of: CBB-affected beans, black beans, beans with mechanical damage, unripe beans, and fermenting beans.

Figure 8:
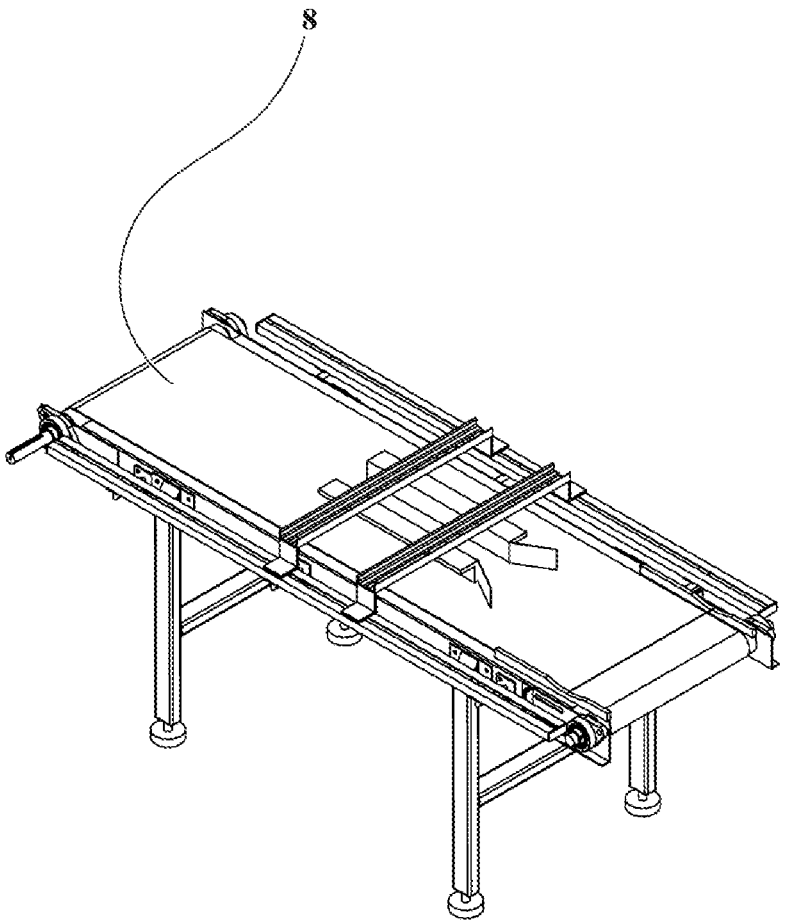
FIG. 8 illustrates the conveyor belt of the bean arrangement mechanism of the device of the present disclosure.

Referring to FIGS. 8 and 9, a bean arrangement mechanism, which in one embodiment of the invention is a pneumatic ejection mechanism consisting of 10 pneumatic electrovalves that generate air jets capable of ejecting the defective coffee beans from the main flow.

The device of the invention contains a mechanism that feeds washed coffee beans, a mechanism that arranges coffee beans with the flat side up, an electronic mechanism that identifies defective beans and a pneumatic ejection mechanism.

Coffee beans normally have a flat side and a convex side and must pass through the identification mechanism with the flat side up, because that is the side through which the coffee berry borer bores into the bean and where damage is visible.

One of the technical characteristics of this development consists of taking advantage of the fact that the parchment (endocarp) of the bean is translucent and is attached to the seed (endosperm) when the bean is fully wet, which means that defects such as the small bores made by the coffee berry borer, or seeds of unusual color, show greater contrast and are apparent at a glance (visible). Once the coffee enters the drying process, the endocarp turns opaque and loses its translucency, reason why it is very difficult to identify and extract coffee beans that have been mildly affected by the coffee berry borer.

The mechanisms are described in detail below.

Feeding Mechanism:

The dosage of the washed coffee beans is performed by a rotatory cylinder located under the main reception hopper of the machine. As it rotates, it moves the beans toward one side, creating a descending flow. This mechanism possesses a scraper that detaches the beans that may hold to the surface of the rotatory cylinder due to the adhesive and cohesive forces of water. In one embodiment of the invention, the scraper developed for this purpose consists of a nylon thread, 0.5 mm in diameter, stretched longitudinally between two lateral structures, that touches the cylinder without placing significant resistance on its movement. In the case of the dosage mechanism, the flow depends on the angular velocity of the cylinder, and on the distance between the hopper's outflow and the cylinder; greater angular velocity results in greater feeding, and greater height results in greater feeding.

FIGS. 1 and 2 show in detail the dosage mechanism and its parts, the main hopper (1), the rotary cylinder (2) and the nylon thread scraper (3). The walls of the main hopper of the machine possess longitudinal rods that prevent the washed coffee beans from becoming attached to these surfaces and forming bridges that would later block the continuous flow of coffee beans.

Bean Arrangement Mechanism

Once the coffee bean mass is in a state of constant feeding, it passes into a mechanism that arranges the beans with the flat side up. Since coffee beans contain surface water, the aforementioned bean arrangement mechanism uses the principles of adhesive and cohesive forces of fluids in relation to various surfaces. Thus, when a washed coffee bean is placed with its flat side on a smooth surface, there is a high probability that it will attach to the surface due to the adhesive and cohesive forces of water between the surface and the exterior layer of the bean. If the washed coffee bean is placed with its convex face on the same smooth surface, the adhesive and cohesive forces would not be strong enough to hold it, because these forces depend on the contact area.

Figure 6:
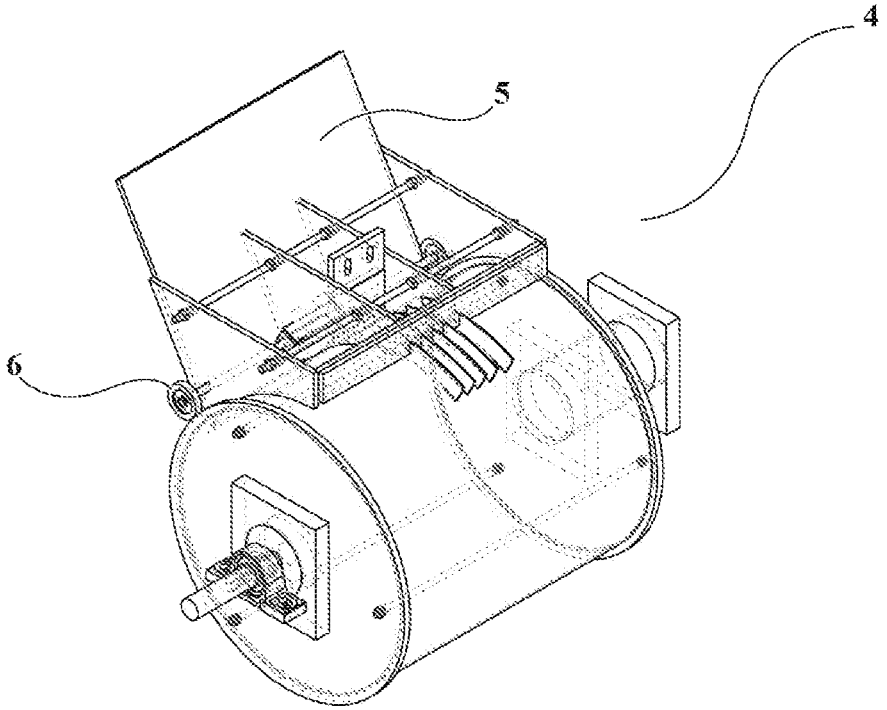
FIG. 6 exhibits a perspective of the bean arrangement mechanism of a preferred embodiment of the device for classifying beans herein disclosed.
Figure 7:
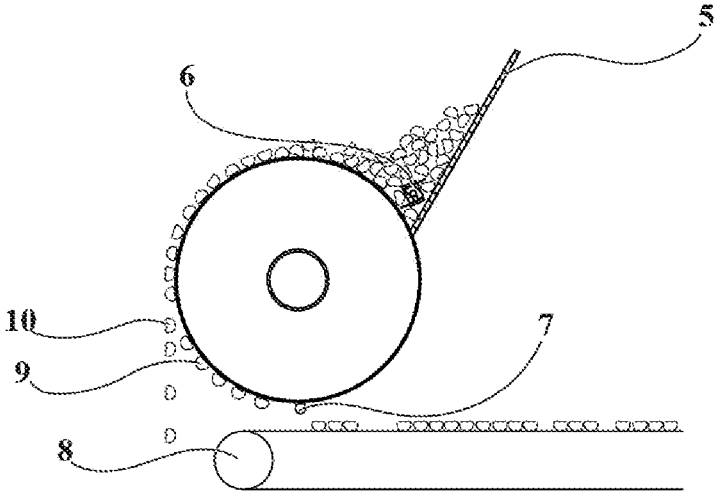
FIG. 7 outlines the bean arrangement mechanism according to a preferred embodiment of the present disclosure.

Referring to FIGS. 2 and 6 and referring to FIG. 7, the bean arrangement mechanism, for example for coffee beans, facing up (FIG. 2) consists of a rotary drum (4), 40 cm in diameter, with a smooth surface, that has a tangential velocity of 0.35 m/s. The washed coffee flows from the feeding mechanism into a container (5), similar to a hopper, which contains a stirring mechanism (6) to break up the bean structures that block the flow.

Referring to FIGS. 2 and 7, the beans that are attached continue to rotate with the drum (9) while the beans with their convex surface facing inward do not attach and fall freely (10) when they reach the orthogonal point of 180° on the drum from FIG. 2.

In one embodiment of the invention, the drum has a nylon thread scraper, 0.5 mm in diameter (7), at 270° on the cylinder from FIG. 2, which breaks the water film of the beans and detaches them. Just under the orthogonal point of 270° there is a conveyor belt (8), with a linear velocity (0.38 m/s) slightly faster than the tangential velocity of the drum, in order to receive the beans arranged with the flat side up and transport them.

Referring to FIGS. 6 and 7, the distance between the conveyor belt and the cylinder is slightly greater than the thickness of one bean (between 8 and 10 mm).

The arrangement mechanism that arranges the coffee beans with the flat side up performs this task highly efficiently. The coffee beans that do no attach and fall freely at the 180° point of the cylinder, are mainly coffee beans that do not have a planar-convex shape, such as triangle and peaberry beans. The small amount of acceptable beans that fall at this point are reprocessed because a bucket elevator returns them to the main hopper.

The mechanism has several flexible attachments that organize and guide the beans into rows so that beans do not stack on top of each other.

Electronic Bean Vision System

Referring to FIGS. 3 and 4, once the beans are arranged on the conveyor belt in an organized fashion and with the flat side facing up, they pass under an inspection hood (11) that contains a lighting mechanism with high intensity LEDs and a CCD digital camera (12), as shown in FIG. 3. A central processing unit analyzes the images captured by the camera in order to determine which beans are acceptable, which are defective and where they are located on the conveyor belt, in order to eject them later.

The central processing unit possesses a series of methods that segment beans and classifies them into categories, for example: acceptable beans, CBB-affected beans, unripe beans, fermented beans, black beans and beans with mechanical damage.

For bean segmentation, a contrasting blue background is utilized. Calibration is required before operating the machine, during which the values to be extracted from the background are determined by dynamic thresholding.

Method 1.

| Stage | Description |
|---|---|
| 1 | Obtaining the digital image |
| 2 | Storing the RGB components |
| 3 | Representing the image in other color spaces |
| 4 | Creating a histogram for each colorimetric and brightness component. |
| 5 | Determining the thresholding point according to the Otsu method (1979) of the selected component. |
| 6 | Obtaining binary image |
| 7 | Removing small areas |
| 8 | Obtaining the border using, for example, the LoG filter (Davies, 2012; Gonzales and Woods, 2008) |
| 9 | Obtaining the vectors that correspond to the beans |

To obtain the "black bean" class, the following method is used:

Method 2. Identification of black beans

| Stage | Description |
|---|---|
| 1 | Averaging the RBG components for each pixel of the image, that is, calculating the image in gray scale. |
| 2 | Extracting the intensity average for the information of each segmented bean. |
| 3 | If the average intensity is less than 80, the corresponding bean is black. |
| 4 | Engaging the bean ejection mechanism |

Figure 10:
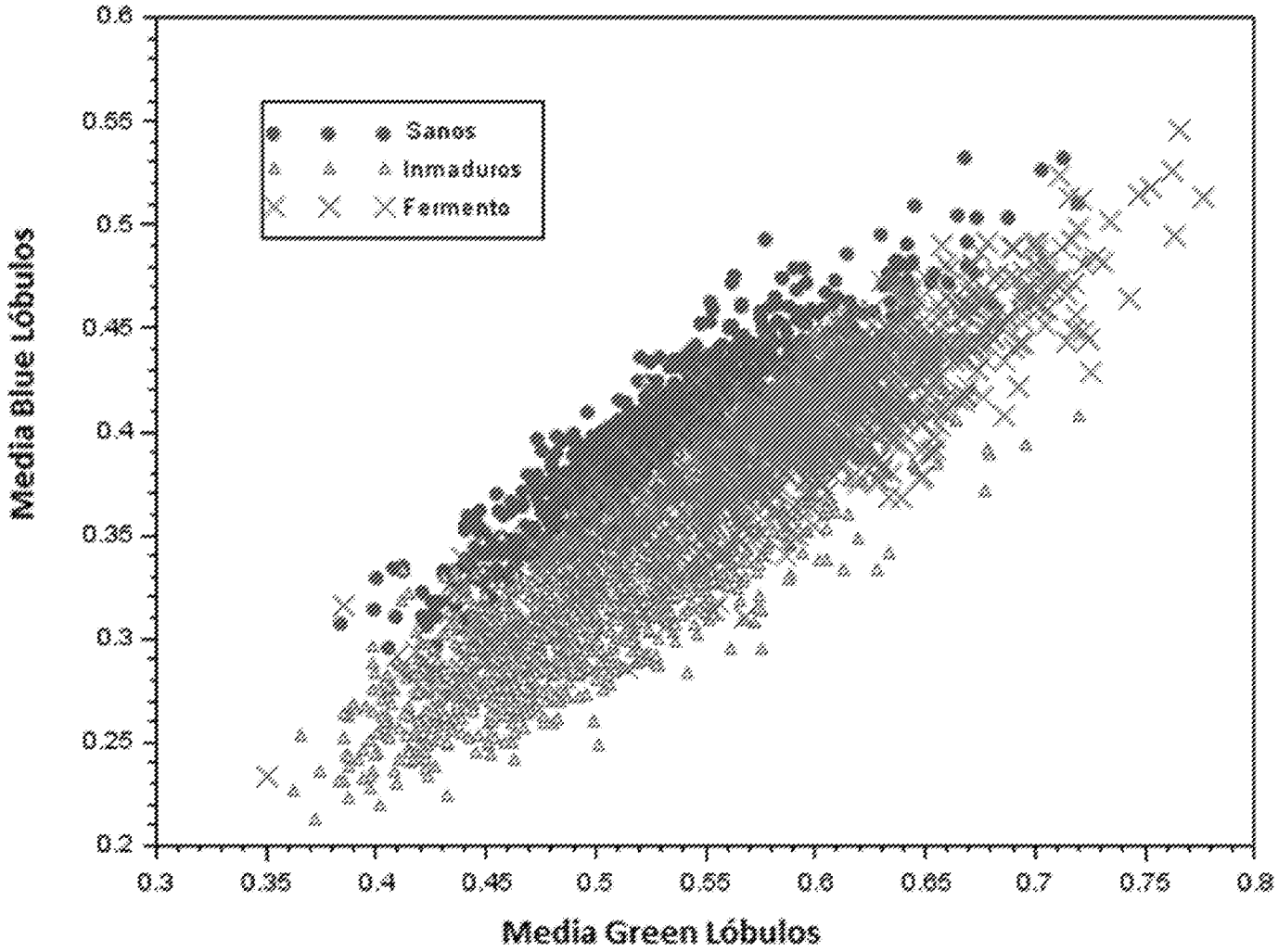
FIG. 10 shows the scatter plot of the average green and blue intensity information (GB Cartesian plane) obtained by the electronic bean vision system of the device herein disclosed, for good, immature, and fermented beans.

For example, to identify an "unripe bean" and a "fermented bean", a scatter plot of the average green and blue intensity information on the GB Cartesian plane (Green-Blue of the RGB color space) is used for a central segment that includes the split part of each bean. FIG. 10 shows the scatter plot. The straight line with a slope of 0.71 separates the healthy beans from the defective unripe and fermented beans. The method developed for that purpose is as follows:

Method 3. Identification of defective fermented and unripe beans

| Stage | Description |
|---|---|
| 1 | Adjusting the vector of the segmented bean to an ellipse and finding the minor and major axes. |
| 2 | Using the major axis as the base and extracting a longitudinal strip that is 1/3rd the width of the minor axis |
| 3 | Obtaining the average G and B intensities of the strip from each bean |
| 4 | If the B/G slope is less than 0.71, the corresponding bean is defective due to fermentation or unripeness. |

-continued

Method 3. Identification of defective fermented and unripe beans

| Stage | Description |
|---|---|
| 5 | Engaging the bean ejection mechanism |

Since the coffee borer beetle drills a bore with an average diameter of 1.23 mm, the following algorithm is used to identify beans that have been damaged by insects:

Method 4. Identification of beans affected by the coffee borer beetle

| Stage | Description |
|---|---|
| 1 | Take the matrix of each bean |
| 2 | Move a 5 × 5 pixel mask in an orderly manner |
| 3 | If the mask matches an area with a gray intensity less than 50 (dark), it is deemed to be a washed coffee bean affected by an insect |
| 4. | Engaging the bean ejection mechanism |

Beans with mechanical damage usually have an incomplete shape. To determine which beans have these defects, an ellipse is adjusted and the integrity of the shape is determined as shown in the following algorithm:

Method 5. Identification of beans with mechanical damage

| Stage | Description |
|---|---|
| 1 | Adjust the vector of the segmented bean to an ellipse. |
| 2 | Determine the area of the ellipse |
| 3 | Determine the area of the bean |
| 4 | Obtain the ratio of the areas |
| 5 | If the ratio of the areas is less than 80%, the corresponding bean is considered to have mechanical damage. |
| 6 | Engaging the bean ejection mechanism |

The methods have an identification effectiveness of 90%.

Bean Ejection Mechanism:

Referring to FIGS. 8 and 9, as a result of the above process, the central processing unit sends digital activation signals (on/off) to the electrovalves of the ejectors. The air streams produced eject the defective beans from the main flow.

In one embodiment of the invention, the washed coffee beans are classified into five types of defective beans: CBB-affected coffee beans, black coffee beans, unripe coffee beans, fermented coffee beans, and mechanically damaged coffee beans. It should be understood that the present invention is not restricted to the embodiments describes and illustrated herein, since, as is obvious to a person with ordinary skill in the art, there are possible variations and modifications that no not deviate from the spirit of the invention, which is only defined by the following claims.

The invention claimed is:

1. A device for classifying beans comprising:

a bean feeding mechanism;

a bean arrangement mechanism connected to the bean feeding mechanism, which arranges washed coffee beans with a flat side up;

an electronic bean vision system, operationally placed within an inspection hood oriented towards the flat side of the washed coffee beans;

a bean ejection mechanism, located after the inspection hood;

wherein the bean arrangement mechanism comprises a rotatory drum with a smooth surface, and the flat side of the beans attaches to the smooth surface of the drum and after a rotation of 180° a scraper detaches the beans with the flat side up, and wherein the electronic bean vision system has a central processing unit that implements methods for classifying beans.

2. A method for classifying bean, comprising:

arranging washed coffee beans with a flat side up in the device of claim 1;

capturing a digital image of the beans using the electronic bean vision system;

storing RGB components of the digital image, creating a first histogram;

creating a second histogram for each colorimetric and brightness component of the first histogram;

determining the thresholding point according to the Otsu method;

obtaining a binary image;

removing small areas of the binary image;

obtaining the borders of the binary image;

obtaining the vectors that correspond to the beans;

identifying black beans by calculating an average of image intensity for each bean in gray scale and comparing the average with a first threshold value;

identifying defective fermented and unripe beans; by calculating an RBG average of green and blue intensity from the RGB components and comparing the RBG average with a second threshold value;

identifying beans affected by coffee borer beetle by calculating a matrix of a bean image and moving a 5×5 pixel mask over the matrix;

identifying beans with mechanical damage; by calculating an area of a bean and an area of an ellipse adjusted to a bean; and engaging the bean ejection mechanism by activating actuators for black beans, defective fermented or unripe beans, beans affected by the coffee borer beetle and beans with mechanical damage.

3. The device for classifying beans according to claim 1, wherein the bean feeding mechanism comprises a rotatory cylinder.

4. The device for classifying beans according to claim 1 wherein the bean arrangement mechanism comprises a container having a stirring mechanism.

5. The device for classifying beans according to claim 1, wherein the bean arrangement mechanism arranges the washed coffee beans with the flat side up on a conveyor belt, wherein the electronic bean vision system is located above the conveyor belt and wherein the ejection mechanism comprises at least one ejector comprising a pneumatic electrovalve.

6. The device for classifying beans according to claim 1 wherein the central processing unit is configured for:

identifying black beans by calculating an average intensity of an image of each bean in a grey scale and comparing the average with a threshold value;

identifying beans with defects in fermentation or unripe beans by calculating average intensities of green and blue color in a GB Cartesian plane and comparing the average with a threshold value;

identifying beans with mechanical damage by calculating a bean area and an ellipse area adjusted to the bean; and engaging the bean ejection mechanism, activating one or more ejectors to eject from the main flow identified black beans, beans with defects in fermentation, unripe beans, and beans with mechanical damage.

* * * * *